US009208930B2

(12) United States Patent
Kosowsky et al.

(10) Patent No.: US 9,208,930 B2
(45) Date of Patent: Dec. 8, 2015

(54) VOLTAGE SWITCHABLE DIELECTRIC MATERIAL CONTAINING CONDUCTIVE CORE SHELLED PARTICLES

(75) Inventors: Lex Kosowsky, San Jose, CA (US); Robert Fleming, San Jose, CA (US); Junjun Wu, Woodbury, MN (US); Pragnya Saraf, San Jose, CA (US); Thangamani Ranganathan, San Jose, CA (US)

(73) Assignee: LITTELFUSE, INC., Chicago, IL (US)

( * ) Notice: Subject to any disclaimer, the term of this patent is extended or adjusted under 35 U.S.C. 154(b) by 1023 days.

(21) Appl. No.: 12/571,318

(22) Filed: Sep. 30, 2009

(65) Prior Publication Data

US 2010/0090178 A1 Apr. 15, 2010

Related U.S. Application Data

(60) Provisional application No. 61/101,637, filed on Sep. 30, 2008.

(51) Int. Cl.

*H01B 1/22* (2006.01)
*H01C 7/10* (2006.01)
*H01B 1/20* (2006.01)

(52) U.S. Cl.

CPC .. *H01C 7/10* (2013.01); *H01B 1/22* (2013.01); *H01B 1/20* (2013.01)

(58) Field of Classification Search

CPC ..... H01B 1/20; H01B 1/22
USPC ..... 252/500, 518.1, 519.3, 519.33; 257/536
See application file for complete search history.

(56) References Cited

U.S. PATENT DOCUMENTS 3,347,724 A 10/1967 Schneble, Jr. et al.
3,685,026 A 8/1972 Wakabayashi et al.
3,685,028 A 8/1972 Wakabayashi et al.
3,723,635 A 3/1973 Smith
3,808,576 A 4/1974 Castonguay et al.
3,926,916 A 12/1975 Mastrangelo
3,977,957 A 8/1976 Kosowsky et al.
4,113,899 A 9/1978 Henry et al.
4,133,735 A 1/1979 Afromowitz et al.
4,252,692 A 2/1981 Taylor et al.
4,331,948 A 5/1982 Malinaric et al.
4,359,414 A 11/1982 Mastrangelo
4,405,432 A 9/1983 Kosowsky
4,439,809 A 3/1984 Weight et al.
4,506,285 A 3/1985 Einzinger
4,591,411 A 5/1986 Reimann
4,642,160 A 2/1987 Burgess
4,702,860 A 10/1987 Kinderov et al.
4,726,877 A 2/1988 Fryd et al.
4,726,991 A 2/1988 Hyatt et al.
4,799,128 A 1/1989 Chen
4,888,574 A 12/1989 Rice et al.
4,892,776 A 1/1990 Rice
4,918,033 A 4/1990 Bartha et al.
4,928,199 A 5/1990 Diaz et al.
4,935,584 A 6/1990 Boggs
4,977,357 A 12/1990 Shrier
4,992,333 A 2/1991 Hyatt
4,996,945 A 3/1991 Dix, Jr.
5,068,634 A 11/1991 Shrier
5,092,032 A 3/1992 Murakami
5,095,626 A 3/1992 Kitamura et al.
5,099,380 A 3/1992 Childers et al.
5,142,263 A 8/1992 Childers et al.
5,148,355 A 9/1992 Lowe et al.
5,183,698 A 2/1993 Stephenson et al.
5,189,387 A 2/1993 Childers et al.
5,246,388 A 9/1993 Collins et al.
5,248,517 A 9/1993 Shrier et al.
5,252,195 A 10/1993 Kobayashi et al.
5,260,108 A 11/1993 Braren et al.
5,260,848 A 11/1993 Childers
5,262,754 A 11/1993 Collins
5,278,535 A 1/1994 Xu et al.
5,282,312 A 2/1994 DiStefano et al.
5,294,374 A 3/1994 Martinez et al.
5,295,297 A 3/1994 Kitamura et al.
5,300,208 A 4/1994 Angelopoulos et al.
5,317,801 A 6/1994 Tanaka et al.
5,340,641 A 8/1994 Xu
5,347,258 A 9/1994 Howard et al.
5,354,712 A 10/1994 Ho et al.
5,367,764 A 11/1994 DiStefano et al.
5,378,858 A 1/1995 Bruckner et al.

(Continued)

FOREIGN PATENT DOCUMENTS

CH 663491 A5 12/1987
DE 3040784 A1 5/1982

(Continued)

OTHER PUBLICATIONS

U.S. Appl. No. 11/903,820, filed Sep. 24, 2007, Kosowsky et al.
U.S. Appl. No. 12/714,354, filed Feb. 26, 2010, Fleming et al.
U.S. Appl. No. 12/714,358, filed Feb. 26, 2010, Fleming et al.
U.S. Appl. No. 12/717,102, filed Mar. 3, 2010, Kosowsky et al.
U.S. Appl. No. 12/731,557, filed Mar. 25, 2010, Kosowsky.
Fullerene Chemistry—Wikipedia, http://en.wikipedia.org/wiki/Fullerene/chemistry, 6 pages, printed Apr. 8, 2010.

(Continued)

*Primary Examiner* — Khanh Tuan Nguyen
*Assistant Examiner* — Haidung Nguyen
(74) *Attorney, Agent, or Firm* — Kacvinsky Daisak Bluni PLLC

(57) ABSTRACT

A composition of voltage switchable dielectric (VSD) material that comprises a concentration of core shelled particles that individually comprise a conductor core and a shell, the shell of each core shelled particle being (i) multilayered, and/or (ii) heterogeneous.

28 Claims, 4 Drawing Sheets

(56) References Cited

U.S. PATENT DOCUMENTS 5,380,679 A 1/1995 Kano
5,393,597 A 2/1995 Childers et al.
5,403,208 A 4/1995 Felcman et al.
5,404,637 A 4/1995 Kawakami
5,413,694 A 5/1995 Dixon et al.
5,416,662 A 5/1995 Kurasawa et al.
5,440,075 A 8/1995 Kawakita et al.
5,444,593 A 8/1995 Allina
5,476,471 A 12/1995 Shifrin et al.
5,481,795 A 1/1996 Hatakeyama et al.
5,483,407 A 1/1996 Anastasio et al.
5,487,218 A 1/1996 Bhatt et al.
5,493,146 A 2/1996 Pramanik et al.
5,501,350 A 3/1996 Yoshida et al.
5,502,889 A 4/1996 Casson et al.
5,510,629 A 4/1996 Karpovich et al.
5,550,400 A 8/1996 Takagi et al.
5,557,136 A 9/1996 Gordon et al.
5,654,564 A 8/1997 Mohsen
5,669,381 A 9/1997 Hyatt
5,685,070 A 11/1997 Alpaugh et al.
5,708,298 A 1/1998 Masayuki et al.
5,714,794 A 2/1998 Tsuyama et al.
5,734,188 A 3/1998 Murata et al.
5,744,759 A 4/1998 Ameen et al.
5,781,395 A 7/1998 Hyatt
5,802,714 A 9/1998 Kobayashi et al.
5,807,509 A 9/1998 Shrier et al.
5,808,351 A 9/1998 Nathan et al.
5,834,160 A 11/1998 Ferry et al.
5,834,824 A 11/1998 Shepherd et al.
5,834,893 A 11/1998 Bulovic et al.
5,848,467 A 12/1998 Khandros et al.
5,856,910 A 1/1999 Yurchenco et al.
5,865,934 A 2/1999 Yamamoto et al.
5,869,869 A 2/1999 Hively
5,874,902 A 2/1999 Heinrich et al.
5,906,042 A 5/1999 Lan et al.
5,910,685 A 6/1999 Watanabe et al.
5,926,951 A 7/1999 Khandros et al.
5,940,683 A 8/1999 Holm et al.
5,946,555 A 8/1999 Crumly et al.
5,955,762 A 9/1999 Hivley
5,956,612 A 9/1999 Elliott et al.
5,962,815 A 10/1999 Lan et al.
5,970,321 A 10/1999 Hively
5,972,192 A 10/1999 Dubin et al.
5,977,489 A 11/1999 Crotzer et al.
6,013,358 A 1/2000 Winnett et al.
6,023,028 A 2/2000 Neuhalfen
6,064,094 A 5/2000 Intrater et al.
6,108,184 A 8/2000 Minervini et al.
6,114,672 A 9/2000 Iwasaki et al.
6,130,459 A 10/2000 Intrater
6,160,695 A 12/2000 Winnett et al.
6,172,590 B1 1/2001 Shrier et al.
6,184,280 B1 2/2001 Shibuta
6,191,928 B1 2/2001 Rector et al.
6,198,392 B1 3/2001 Hahn et al.
6,211,554 B1 4/2001 Whitney et al.
6,239,687 B1 5/2001 Shrier et al.
6,251,513 B1 6/2001 Rector et al.
6,310,752 B1 10/2001 Shrier et al.
6,316,734 B1 11/2001 Yang
6,340,789 B1 1/2002 Petritsch et al.
6,351,011 B1 2/2002 Whitney et al.
6,373,719 B1 4/2002 Behling et al.
6,407,411 B1 6/2002 Wojnarowski et al.
6,433,394 B1 8/2002 Intrater
6,448,900 B1 9/2002 Chen
6,455,916 B1 9/2002 Robinson
6,468,593 B1 10/2002 Iizawa et al.
6,512,458 B1 1/2003 Kobayashi et al.
6,534,422 B1 3/2003 Ichikawa et al.
6,542,065 B2 4/2003 Shrier et al.
6,549,114 B2 4/2003 Whitney et al.
6,570,765 B2 5/2003 Behling et al.
6,593,597 B2 7/2003 Sheu
6,628,498 B2 9/2003 Whitney et al.
6,642,297 B1 11/2003 Hyatt et al.
6,657,532 B1 12/2003 Shrier et al.
6,693,508 B2 2/2004 Whitney et al.
6,741,217 B2 5/2004 Toncich et al.
6,797,145 B2 9/2004 Kosowsky
6,882,051 B2 4/2005 Majumdar et al.
6,911,676 B2 6/2005 Yoo
6,916,872 B2 7/2005 Yadav et al.
6,981,319 B2 1/2006 Shrier
7,034,652 B2 4/2006 Whitney et al.
7,049,926 B2 5/2006 Shrier et al.
7,053,468 B2 5/2006 Lee
7,064,353 B2 6/2006 Bhat
7,132,697 B2 11/2006 Weimer et al.
7,132,922 B2 11/2006 Harris et al.
7,141,184 B2 11/2006 Chacko et al.
7,173,288 B2 2/2007 Lee et al.
7,183,891 B2 2/2007 Harris et al.
7,202,770 B2 4/2007 Harris et al.
7,205,613 B2 4/2007 Fjelstand et al.
7,218,492 B2 5/2007 Shrier
7,320,762 B2 1/2008 Greuter et al.
7,417,194 B2 8/2008 Shrier
7,446,030 B2 11/2008 Kosowsky
7,528,467 B2 5/2009 Lee
7,609,141 B2 10/2009 Harris et al.
2002/0004258 A1 1/2002 Nakayama et al.
2002/0050912 A1 5/2002 Shrier et al.
2002/0061363 A1 5/2002 Halas et al.
2003/0008989 A1 1/2003 Gore et al.
2003/0010960 A1 1/2003 Greuter et al.
2003/0079910 A1 5/2003 Kosowsky
2003/0151029 A1 8/2003 Hsu et al.
2003/0207978 A1 11/2003 Yadav et al.
2003/0218851 A1 11/2003 Harris et al.
2004/0062041 A1 4/2004 Cross et al.
2004/0063294 A1 4/2004 Durocher et al.
2004/0063839 A1 4/2004 Kawate et al.
2004/0095658 A1 5/2004 Buretea et al.
2004/0154828 A1 8/2004 Moller et al.
2004/0160300 A1 8/2004 Shrier
2004/0201941 A1 10/2004 Harris et al.
2004/0211942 A1 10/2004 Clark et al.
2004/0241894 A1 12/2004 Nagai et al.
2004/0262583 A1* 12/2004 Lee ..... 252/500
2005/0026334 A1 2/2005 Knall
2005/0039949 A1 2/2005 Kosowsky
2005/0057867 A1* 3/2005 Harris et al. ..... 361/56
2005/0083163 A1 4/2005 Shrier
2005/0106098 A1 5/2005 Tsang et al.
2005/0121653 A1 6/2005 Chacko
2005/0184387 A1 8/2005 Collins et al.
2005/0208304 A1 9/2005 Collier et al.
2005/0218380 A1 10/2005 Gramespacher et al.
2005/0274455 A1 12/2005 Extrand
2005/0274956 A1 12/2005 Bhat
2005/0275070 A1 12/2005 Hollingsworth
2006/0035081 A1 2/2006 Morita et al.
2006/0060880 A1 3/2006 Lee et al.
2006/0142455 A1 6/2006 Agarwal et al.
2006/0152334 A1 7/2006 Maercklein et al.
2006/0166474 A1 7/2006 Vereecken et al.
2006/0167139 A1 7/2006 Nelson et al.
2006/0181826 A1 8/2006 Dudnikov, Jr. et al.
2006/0181827 A1 8/2006 Dudnikov, Jr. et al.
2006/0193093 A1 8/2006 Bertin et al.
2006/0199390 A1 9/2006 Dudnikov, Jr. et al.
2006/0211837 A1 9/2006 Ko et al.
2006/0214156 A1 9/2006 Pan et al.
2006/0234127 A1 10/2006 Kim et al.
2006/0291127 A1 12/2006 Kim et al.
2007/0114640 A1 5/2007 Kosowsky
2007/0116976 A1 5/2007 Tan et al.
2007/0123625 A1 5/2007 Dorade et al.
2007/0126018 A1 6/2007 Kosowsky

(56) References Cited

U.S. PATENT DOCUMENTS

| | | | |
|---|---|---|---|
| 2007/0139848 | A1 | 6/2007 | Harris et al. |
| 2007/0146941 | A1 | 6/2007 | Harris et al. |
| 2007/0208243 | A1 | 9/2007 | Gabriel et al. |
| 2008/0023675 | A1 | 1/2008 | Kosowsky |
| 2008/0029405 | A1 | 2/2008 | Kosowsky |
| 2008/0032049 | A1 | 2/2008 | Kosowsky |
| 2008/0035370 | A1 | 2/2008 | Kosowsky |
| 2008/0045770 | A1 | 2/2008 | Sigmund et al. |
| 2008/0073114 | A1 | 3/2008 | Kosowsky |
| 2008/0313576 | A1 | 12/2008 | Kosowsky |
| 2009/0044970 | A1 | 2/2009 | Kosowsky |
| 2009/0050856 | A1 | 2/2009 | Kosowsky |
| 2009/0212266 | A1 | 8/2009 | Kosowsky |
| 2009/0220771 | A1 | 9/2009 | Kosowsky |
| 2009/0242855 | A1 | 10/2009 | Kosowsky |
| 2009/0256669 | A1 | 10/2009 | Kosowsky |
| 2010/0047535 | A1 | 2/2010 | Kosowsky et al. |
| 2010/0263200 | A1 | 10/2010 | Kosowsky |
| 2010/0264224 | A1 | 10/2010 | Kosowsky |
| 2010/0264225 | A1 | 10/2010 | Kosowsky |
| 2010/0270545 | A1 | 10/2010 | Kosowsky |
| 2010/0270546 | A1 | 10/2010 | Kosowsky |
| 2010/0271831 | A1 | 10/2010 | Kosowsky et al. |
| 2010/0281453 | A1 | 11/2010 | Kosowsky et al. |
| 2010/0281454 | A1 | 11/2010 | Kosowsky et al. |

FOREIGN PATENT DOCUMENTS

| | | | |
|---|---|---|---|
| DE | 10115333 | A1 | 1/2002 |
| DE | 102004049053 | A1 | 5/2005 |
| DE | 102006047377 | A1 | 4/2008 |
| EP | 790 758 | A1 | 8/1997 |
| EP | 1 003 229 | A1 | 5/2002 |
| EP | 1 245 586 | A2 | 10/2002 |
| EP | 1 580 809 | A2 | 9/2005 |
| EP | 1 542 240 | A2 | 6/2006 |
| EP | 1 857 871 | A1 | 4/2007 |
| EP | 1 990 834 | A2 | 11/2008 |
| JP | 56091464 | A | 7/1981 |
| JP | 63 195275 | A | 8/1988 |
| JP | 2000 062076 | A | 2/2000 |
| WO | WO 88/00526 | A1 | 1/1988 |
| WO | WO 89/06859 | A2 | 7/1989 |
| WO | WO 96/02922 | A2 | 2/1996 |
| WO | WO 96/02924 | A1 | 2/1996 |
| WO | WO 96/02944 | A1 | 2/1996 |
| WO | WO 97/26665 | A1 | 7/1997 |
| WO | WO 98/23018 | A1 | 5/1998 |
| WO | WO 99/24992 | A1 | 5/1999 |
| WO | WO 99/49525 | A1 | 9/1999 |
| WO | WO 02/103085 | A1 | 12/2002 |
| WO | WO 2005/100426 | A1 | 10/2005 |
| WO | WO 2006/130366 | A2 | 12/2006 |
| WO | WO 2007/062170 | A2 | 5/2007 |
| WO | WO 2007/062171 | A2 | 5/2007 |
| WO | WO 2008/016858 | A1 | 2/2008 |
| WO | WO 2008/016859 | A1 | 2/2008 |
| WO | WO 2008/024207 | A1 | 2/2008 |
| WO | WO 2008/036984 | A2 | 3/2008 |
| WO | WO 2008/153584 | A1 | 12/2008 |
| WO | WO 2009/026299 | A1 | 2/2009 |

OTHER PUBLICATIONS

International Preliminary Report on Patentability for International Application PCT/US2008/073603 mailed Mar. 4, 2010, 7 pages.
International Search Report, Written Opinion and Notice of Transmittal of Same mailed Apr. 16, 2010 for International Application PCT/US2009/062844 20 pages.
International Search Report, Written Opinion and Notice of Transmittal of Same mailed Apr. 20, 2010 for International Application PCT/US2009/059134 22 pages.
International Search Report, Written Opinion, and Notice of Transmittal of same mailed Mar. 18, 2010 for International Application PCT/US2010/021889 15 pages.
Non-Final Office Action mailed Apr. 20, 2010 in U.S. Appl. No. 11/829,946, 20 pages.
Non-Final Office Action dated Apr. 13, 2010 in U.S. Appl. No. 12/714,358, 17 pages.
Non-Final Office Action dated Apr. 13, 2010 in U.S. Appl. No. 12/714,354, 17 pages.
Final Office Action mailed Feb. 23, 2011 in U.S. Appl. 12/714,354.
Translation of Office Action of Jan. 26, 2011 in Chinese Application No. 200780028617.2.
Translation of Office Action of Jan. 26, 2011 in Chinese Application No. 200780028607.9.
U.S. Appl. No. 12/878,344, filed Sep. 9, 2010, Kosowsky et al.
U.S. Appl. No. 12/954,605, filed Nov. 24, 2010, Shi et al.
Examination Report for European Application 06838319.9 mailed May 7, 2010.
Examination Report for European Application 07813509.2-1218 mailed Jul. 2, 2010.
Examination Report for European Application 07813508.4-1218 mailed Jul. 2, 2010.
Examination Report of Jan. 21, 2011 in European Application No. 07813508.4.
Examination Report of Jan. 21, 2011 in European Application No. 07813509.2.
Extended European Search Report for European Application 10158080.1 mailed Jul. 1, 2010.
Final Office Action mailed Oct. 13, 2010 in U.S. Appl. No. 11/829,946.
Final Office Action mailed Oct. 13, 2010 in U.S. Appl. No. 12/714,358.
International Preliminary Report on Patentability mailed Oct. 28, 2010 in PCT/US2009/040384.
International Preliminary Report on Patentability mailed Oct. 7, 2010 in PCT/US2009/038429.
Non-Final Office Action mailed Jul. 20, 2010 in U.S. Appl. No. 11/562,222.
Non-Final Office Action mailed Sep. 27, 2010 in U.S. Appl. No. 12/703,723.
Non-Final Office Action mailed Sep. 28, 2010 in U.S. Appl. No. 12/703,701.
Non-Final Office Action mailed Oct. 6, 2010 in U.S. Appl. No. 12/714,354.
Non-Final Office Action mailed Oct. 14, 2010 in U.S. Appl. No. 12/356,490.
Non-Final Office Action mailed Oct. 22, 2010 in U.S. Appl. No. 12/820,939.
Non-Final Office Action mailed Dec. 1, 2010 in U.S. Appl. No. 12/193,603.
Non-Final Office Action mailed Dec. 21, 2010 in U.S. Appl. No. 11/860,522.
Non-Final Office Action mailed Jan. 13, 2011 in U.S. Appl. No. 12/832,022.
Non-Final Office Action mailed Oct. 7, 2010 in U.S. Appl. No. 12/832,040.
Non-Final Office Action mailed Sep. 27, 2010 in U.S. Appl. No. 11/829,948.
Non-Final Office Action mailed Sep. 28, 2010 in U.S. Appl. No. 12/703,674.
Non-Final Office Action mailed Jan. 20, 2011 in U.S. Appl. No. 11/829,951.
Non-Final Office Action mailed Jan. 13, 2011 in U.S. Appl. No. 12/832,033.
Notice of Allowance mailed Sep. 7, 2010 in U.S. Appl. No. 11/562,289.
Notice of Allowance mailed Jun. 21, 2010 in U.S. Appl. No. 11/860,530.
Office Action Issued Jul. 29, 2010 in Chinese Application No. 200780028607.9.
Translation of Office Action of Jul. 12, 2010 in Chinese Application 200780028617.2.
Translation of Office Action of Jul. 7, 2010 in Chinese Application 200680043524.2.
Translation of Office Action of Oct. 26, 2010 in Chinese App. No. 200780035255.X.

(56) References Cited

OTHER PUBLICATIONS

U.S. Appl. No. 11/562,222, filed Nov. 21, 2006, Kosowsky.
U.S. Appl. No. 12/356,490, filed Jan. 20, 2009, Kosowsky.
U.S. Appl. No. 12/370,589, filed Feb. 12, 2009, Kosowsky.
U.S. Appl. No. 12/561,195, filed Sep. 16, 2009, Kosowsky et al.
U.S. Appl. No. 12/607,952, filed Oct. 28, 2009, Fleming et al.
U.S. Appl. No. 12/638,360, filed Dec. 15, 2009, Fleming et al.
U.S. Appl. No. 12/638,632, filed Dec. 15, 2009, Fleming et al.
U.S. Appl. No. 12/642,799, filed Dec. 19, 2009, Fleming et al.
U.S. Appl. No. 12/692,573, filed Jan. 22, 2010, Fleming et al.
U.S. Appl. No. 12/703,674, filed Feb. 10, 2010, Kosowsky et al.
U.S. Appl. No. 12/703,701, filed Feb. 10, 2010, Kosowsky et al.
U.S. Appl. No. 12/703,723, filed Feb. 10, 2010, Kosowsky et al.
Breton et al., "Mechanical properties of multiwall carbon nanotubes/epoxy composites: influence of network morphology," Carbon Elsevier UK, vol. 42, No. 5-6, pp. 1027-1030 (2004).
Celzard, A., et al., "Conduction Mechanisms in Some Graphite-polymer Composites: The Effect of a Direct-current Electric Field", Journal of Physics: Condensed Matter, 9 (1997) pp. 2225-2237.
Communication of Nov. 23, 2009 with Supp European Search Report and Opinion, European Application No. 06 838 319.9 7 pages.
Communication of Nov. 11, 2009 with Examination Report in European Patent Application No. 07 813 509.2 5 pages.
Communication pf Nov. 9, 2009 with Examination Report in European Patent Application No. 07 813 508.4, 5 pages.
Communication with Examination Report mailed Dec. 23, 2009 in European app. 06838276.1-2203, 6 pgs.
Facchetti, Antonio, "Semiconductors for Organic Transistors", Materials Today, vol. 10, No. 3, pp. 28-37. (2007).
Granstrom et al., "Laminated fabrication of polymeric photovoltaic diodes," Nature, vol. 395, pp. 257-260 (1998).
Guo et al., "Block Copolymer Modified Novolac Epoxy Resin," Polymer Physics, vol. 41, No. 17, pp. 1994-2003 (2003).
International Preliminary Report on Patentability in International Application PCT/US2007/074677, Feb. 3, 2009, 8 pages.
International Preliminary Report on Patentability for International Application PCT/US06/045291, ISA/US, mailed Mar. 24, 2009, 8 pages.
International Preliminary Report on Patentability for International Application PCT/US07/079377 mailed Dec. 30, 2009, 8 pages.
International Search Report and Written Opinion in International Application PCT/US2007/079345, mailed Nov. 7, 2008, 25 pages.
International Search Report and Written Opinion of the International Searching Authority in International Application PCT/US2007/074677, European Patent Office, Dec. 5, 2007, 13 pages.
International Search Report and Written Opinion of the International Searching Authority in International Application PCT/US2008/073603, US Patent Office, Nov. 17, 2008, 7 pages.
International Search Report and Written Opinion in International Application PCT/US2009/038429 mailed Aug. 18, 2009, 20 pgs.
International Search Report and Written Opinion of the International Searching Authority in International Application PCT/US2007/079377, European Patent Office, Mar. 7, 2008, 13 pages.
International Search Report and Written Opinion of the International Searching Authority in International Application PCT/US06/45291, United States Patent Office, Mar. 5, 2008, 14 pages.
International Search Report and Written Opinion of the International Searching Authority in International Application PCT/US09/040384, European Patent Office, Jul. 2, 2009, 15 pages.
International Search Report and Written Opinion mailed Nov. 12, 2009 in International Application PCT/US2009/054062, 15 pages.
International Search Report and Written Opinion mailed Nov. 17, 2009 in International Application PCT/US2009/057209, 14 pages.
International Search Report and Written Opinion of the International Searching Authority in International Application PCT/US06/45292, United States Patent Office, Feb. 14, 2008, 10 pages.
Levinson et al., "The Physics of metal oxide varistors," J. Applied Physics, 46(3): 1332-1341 (1975).
Modine, F.A. and Hyatt, H.M. "New Varistor Material", Journal of Applied Physics, 64 (8), Oct. 15, 1988, pp. 4229-4232.
Notice of Allowance Jan. 14, 2010 U.S. Appl. No. 11/562,289 9pages.
Onoda et al., "Photoinduced Charge Transfer of Conducting Polymer Compositions," IEICE Trans. Electronics, vol. E81-C(7), pp. 1051-1056 (1998).
Raffaelle et al., "Nanomaterial Development for Polymeric Solar Cells," IEEE 4th World Conf on Photovoltaic energy Conversion, pp. 186-189 (2006).
Reese, Colin and Bao, Zhenan, "Organic Single-Crystal Field-Effect Transistors", Materials Today, vol. 10, No. 3, pp. 20-27. (2007).
Saunders et al., "Nanoparticle-polymer photovoltaic cells," Adv. Colloid Int. Sci., vol. 138, No. 1, pp. 1-23 (2007).

* cited by examiner

VOLTAGE SWITCHABLE DIELECTRIC MATERIAL CONTAINING CONDUCTIVE CORE SHELLED PARTICLES

RELATED APPLICATIONS

This application claims benefit of priority to Provisional U.S. Patent Application No. 61/101,637 filed Sep. 30, 2008; the aforementioned priority application being hereby incorporated by reference in its entirety.

TECHNICAL FIELD

Embodiments described herein pertain generally to voltage switchable dielectric material, and more specifically to voltage switchable dielectric composite materials containing core shelled compounds.

BACKGROUND

Voltage switchable dielectric (VSD) materials are materials that are insulative at low voltages and conductive at higher voltages. These materials are typically composites comprising of conductive, semiconductive, and insulative particles in an insulative polymer matrix. These materials are used for transient protection of electronic devices, most notably electrostatic discharge protection (ESD) and electrical overstress (EOS). Generally, VSD material behaves as a dielectric, unless a characteristic voltage or voltage range is applied, in which case it behaves as a conductor. Various kinds of VSD material exist. Examples of voltage switchable dielectric materials are provided in references such as U.S. Pat. No. 4,977,357, U.S. Pat. No. 5,068,634, U.S. Pat. No. 5,099,380, U.S. Pat. No. 5,142,263, U.S. Pat. No. 5,189,387, U.S. Pat. No. 5,248,517, U.S. Pat. No. 5,807,509, WO 96/02924, and WO 97/26665, all of which are incorporated by reference herein.

VSD materials may be formed in using various processes. One conventional technique provides that a layer of polymer is filled with high levels of metal particles to very near the percolation threshold, typically more than 25% by volume. Semiconductor and/or insulator materials is then added to the mixture.

Another conventional technique provides for forming VSD material by mixing doped metal oxide powders, then sintering the powders to make particles with grain boundaries, and then adding the particles to a polymer matrix to above the percolation threshold.

Other techniques for forming VSD material are described in U.S. patent application Ser. No. 11/829,946, entitled VOLTAGE SWITCHABLE DIELECTRIC MATERIAL HAVING CONDUCTIVE OR SEMI-CONDUCTIVE ORGANIC MATERIAL; and U.S. patent application Ser. No. 11/829,948, entitled VOLTAGE SWITCHABLE DIELECTRIC MATERIAL HAVING HIGH ASPECT RATIO PARTICLES.

DETAILED DESCRIPTION

Figure 1:
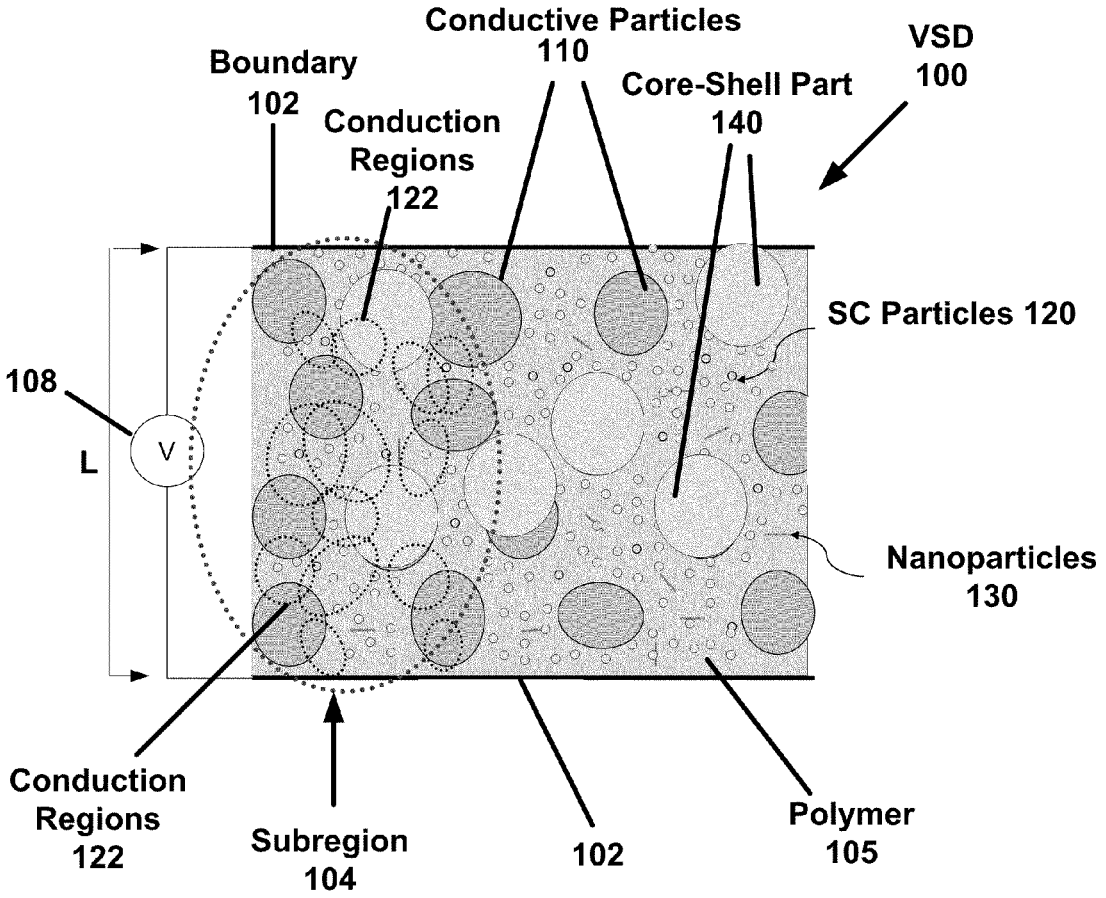
FIG. 1 is an illustrative (not to scale) sectional view of a layer or thickness of VSD material, depicting the constituents of VSD material in accordance with various embodiments.

Embodiments described herein provide a composition of voltage switchable dielectric (VSD) material that comprises conductive core shelled particles. According to embodiments, VSD material is formulated having particle constituents that individually include a conductive core and one or more shell layers. In some embodiments, the VSD material includes multiple shell layers for corresponding conductive core centers.

Still further, an embodiment provides for a composition of voltage switchable dielectric (VSD) material that includes a concentration of core shelled particles that individually comprise a conductor core and a shell, with the shell of each core shelled particle being (i) multilayered, and/or (ii) heterogeneous.

Still further, some embodiments include a composition that includes a binder having multiple types particle constituents uniformly mixed therein. The multiple types of particle constituents include a concentration of conductor and/or semiconductor particle constituents, and a concentration of particles that include conductive core shelled particles. In particular, the core shelled particles may be conductive, core multi-layered shell (CCMLS) particles. As an addition or alternative, the core shelled particles may be comprised of a heterogeneous shell. The resulting VSD composition is (i) dielectric in absence of a voltage that exceeds a characteristic voltage level, and (ii) conductive with application of a voltage that exceeds a characteristic voltage level of the composition.

Overview of VSD Material

As used herein, "voltage switchable material" or "VSD material" is any composition, or combination of compositions, that has a characteristic of being dielectric or non-conductive, unless a field or voltage is applied to the material that exceeds a characteristic level of the material, in which case the material becomes conductive. Thus, VSD material is a dielectric unless voltage (or field) exceeding the characteristic level (e.g. such as provided by ESD events) is applied to the material, in which case the VSD material is switched into a conductive state. VSD material can further be characterized as a nonlinear resistance material. With an embodiment such as described, the characteristic voltage may range in values that exceed the operational voltage levels of the circuit or device several times over. Such voltage levels may be of the order of transient conditions, such as produced by electrostatic discharge, although embodiments may include use of planned electrical events. Furthermore, one or more embodiments provide that in the absence of the voltage exceeding the characteristic voltage, the material behaves similar to the binder.

Still further, an embodiment provides that VSD material may be characterized as material comprising a binder mixed in part with conductor or semi-conductor particles. In the absence of voltage exceeding a characteristic voltage level, the material as a whole adapts the dielectric characteristic of the binder. With application of voltage exceeding the characteristic level, the material as a whole adapts conductive characteristics.

Many compositions of VSD material provide desired 'voltage switchable' electrical characteristics by dispersing a quantity of conductive materials in a polymer matrix to just below the percolation threshold, where the percolation threshold is defined statistically as the threshold by which a continuous conduction path is likely formed across a thickness of the material. Other materials, such as insulators or semiconductors, may be dispersed in the matrix to better control the percolation threshold. Still further, other compositions of VSD material, including some that include particle constituents such as core shell particles (as described herein) or other particles may load the particle constituency above the percolation threshold. As described by embodiments, the VSD material may be situated on an electrical device in order to protect a circuit or electrical component of device (or specific sub-region of the device) from electrical events, such as ESD or EOS. Accordingly, one or more embodiments provide that VSD material has a characteristic voltage level that exceeds that of an operating circuit or component of the device.

According to embodiments described herein, the constituents of VSD material may be uniformly mixed into a binder or polymer matrix. In one embodiment, the mixture is dispersed at nanoscale, meaning the particles that comprise the organic conductive/semi-conductive material are nano-scale in at least one dimension (e.g. cross-section) and a substantial number of the particles that comprise the overall dispersed quantity in the volume are individually separated (so as to not be agglomerated or compacted together).

Still further, an electronic device may be provided with VSD material in accordance with any of the embodiments described herein. Such electrical devices may include substrate devices, such as printed circuit boards, semiconductor packages, discrete devices, Light Emitting Diodes (LEDs), and radio-frequency (RF) components.

VSD Composite with Core Shelled Particles

In some applications, inherent issues may arise with the use of VSD composites that load particles to just below the percolation threshold. In particular, embodiments described herein recognize that some VSD compositions incorporate carbon nanotubes, conductive polymers, and other graphitic compounds. But in instances when these particles are loaded into a matrix of the composition to levels that are 'just below' percolation levels, the conductive nature of the particles can have higher than desired current leakage and/or very low loading levels. Other semiconductive particles or nanorods such as titanium dioxide, tin oxide, or antimony doped tin oxide are not as conductive and therefore can be loaded to high levels. However, these materials are not as conductive and therefore cannot conduct as much current in the "on state"; thereby not providing as much ESD protection. Hence, it is desirable to be able to "tune" the conductivity and bandgap of the polymer, particle, nanoparticle, and/or nanorods to optimize the balance between "on state" resistance and "off state" resistance, i.e. maximize off state resistance, and minimize on state resistance.

Embodiments described herein enable core shell particles to be comprised of core or shell material that has a desired electrical or physical characteristic. In this way, the core or shell material of the core shell particle is selected to form a core shell particle constituent of VSD material that tunes a desired electrical or physical characteristic of the overall composition of VSD material.

Still further, some embodiments described herein recognize that for many VSD composites, after a layer or quantity of the VSD material has been pulsed with a high voltage ESD event (or simulated version thereof), some current must flow through the polymer matrix between the conductive particles. As a result, degrading side reactions may arise, most likely due to the high electron flow and localized heating in the polymer.

Embodiments described herein include composites of VSD material that incorporate core shelled particles, such as CCMLS particles or core shelled particles that have heterogeneous shell layers. The inclusion of such core shelled particles enhances desired electrical characteristics from the VSD composition (e.g. reduction in leakage current).

FIG. 1 is an illustrative (not to scale) sectional view of a layer or thickness of VSD material, depicting the constituents of VSD material in accordance with various embodiments. As depicted, VSD material 100 includes matrix binder 105 and various types of particle constituents, dispersed in the binder in various concentrations. The particle constituents of the VSD material may include a combination of conductive particles 110, semiconductor particles 120, nano-dimensioned particles 130 and/or core shelled particles 140. In some implementations, the core shelled particles 140 may substitute for some or all of the conductive particles 110. As an alternative or variation, the VSD composition may omit the use of conductive particles 110, semiconductive particles 120, or nano-dimensioned particles 130, particularly with the presence of a concentration of core shelled particles 140. Thus, the type of particle constituent that are included in the VSD composition may vary, depending on the desired electrical and physical characteristics of the VSD material. For example, some VSD compositions may include conductive particles 110, but not semiconductive particles 120 and/or nano-dimensioned particles 130. Still further, other embodiments may omit use of conductive particles 110.

Examples for matrix binder 105 include polyethylenes, silicones, acrylates, polymides, polyurethanes, epoxies, polyamides, polycarbonates, polysulfones, polyketones, and copolymers, and/or blends thereof.

Examples of conductive materials 110 include metals such as copper, aluminum, nickel, silver, gold, titanium, stainless steel, nickel phosphorus, niobium, tungsten, chrome, other metal alloys, or conductive ceramics like titanium diboride or titanium nitride. Examples of semiconductive material 120 include both organic and inorganic semiconductors. Some inorganic semiconductors include, silicon carbide, Boron-nitride, aluminum nitride, nickel oxide, zinc oxide, zinc sulfide, bismuth oxide, titanium dioxide, cerium oxide, bismuth oxide, tin oxide, indium tin oxide, antimony tin oxide, and iron oxide, praseodynium oxide. The specific formulation and composition may be selected for mechanical and electrical properties that best suit the particular application of the VSD material. The nano-dimensioned particles 130 may be of one or more types. Depending on the implementation, at least one constituent that comprises a portion of the nano-dimensioned particles 130 are (i) organic particles (e.g. carbon nanotubes, graphenes); or (ii) inorganic particles (metallic, metal oxide, nanorods, or nanowires). The nano-dimensioned particles may have high-aspect ratios (HAR), so as to have aspect ratios that exceed at least 10:1 (and may exceed 1000:1 or more). The particle constituents may be uniformly dispersed in the polymer matrix or binder at various concentrations. Specific examples of such particles include copper, nickel, gold, silver, cobalt, zinc oxide, tin oxide, silicon carbide, gallium arsenide, aluminum oxide, aluminum nitride, titanium dioxide, antimony, Boron-nitride, tin oxide, indium tin oxide, indium zinc oxide, bismuth oxide, cerium oxide, and antimony zinc oxide.

The dispersion of the various classes of particles in the matrix 105 may be such that the VSD material 100 is non-layered and uniform in its composition, while exhibiting electrical characteristics of voltage switchable dielectric material. Generally, the characteristic voltage of VSD material is measured at volts/length (e.g. per 5 mil), although other field measurements may be used as an alternative to voltage. Accordingly, a voltage 108 applied across the boundaries 102 of the VSD material layer may switch the VSD material 100 into a conductive state if the voltage exceeds the characteristic voltage for the gap distance L.

As depicted by a sub-region 104 (which is intended to be representative of the VSD material 100), VSD material 100 comprises particle constituents that individually carry charge when voltage or field acts on the VSD composition. If the field/voltage is above the trigger threshold, sufficient charge is carried by at least some types of particles to switch at least a portion of the composition 100 into a conductive state. More specifically, as shown for representative sub-region 104, individual particles (of types such as conductor particles, core shell particles or other semiconductive or compound particles) acquire conduction regions 122 in the polymer binder 105 when a voltage or field is present. The voltage or field level at which the conduction regions 122 are sufficient in magnitude and quantity to result in current passing through a thickness of the VSD material 100 (e.g. between boundaries 102) coincides with the characteristic trigger voltage of the composition. FIG. 1 illustrates presence of conduction regions 122 in a portion of the overall thickness. The portion or thickness of the VSD material 100 provided between the boundaries 102 may be representative of the separation between lateral or vertically displaced electrodes. When voltage is present, some or all of the portion of VSD material can be affected to increase the magnitude or count of the conduction regions in that region. When voltage is applied, the presence of conduction regions may vary across the thickness (either vertical or lateral thickness) of the VSD composition, depending on, for example, the location and magnitude of the voltage of the event. For example, only a portion of the VSD material may pulse, depending on voltage and power levels of the electrical event.

Accordingly, FIG. 1 illustrates that the electrical characteristics of the VSD composition, such as conductivity or trigger voltage, may be affected in part by (i) the concentration of particles, such as conductive particles, nanoparticles (e.g. HAR particles), varistor particles, and/or core shell particles (as described herein); (ii) electrical and physical characteristics of the particles, including resistive characteristics (which are affected by the type of particles, such as whether the particles are core shelled or conductors); and (iii) electrical characteristics of the polymer or binder.

Specific compositions and techniques by which organic and/or HAR particles are incorporated into the composition of VSD material is described in U.S. patent application Ser. No. 11/829,946, entitled VOLTAGE SWITCHABLE DIELECTRIC MATERIAL HAVING CONDUCTIVE OR SEMI-CONDUCTIVE ORGANIC MATERIAL; and U.S. patent application Ser. No. 11/829,948, entitled VOLTAGE SWITCHABLE DIELECTRIC MATERIAL HAVING HIGH ASPECT RATIO PARTICLES; both of the aforementioned patent applications are incorporated by reference in their respective entirety by this application.

Some embodiments may provide for VSD material that includes varistor particles as a portion of its particle constituents. Embodiments may incorporate a concentration of particles that individually exhibit non-linear resistive properties, so as to be considered active varistor particles. Such particles typically comprise zinc oxide, titanium dioxide, Bismuth oxide, Indium oxide, tin oxide, nickel oxide, copper oxide, silver oxide, praseodymium oxide, Tungsten oxide, and/or antimony oxide. Such a concentration of varistor particles may be formed from sintering the varistor particles (e.g. zinc oxide) and then mixing the sintered particles into the VSD composition. In some applications, the varistor particle compounds are formed from a combination of major components and minor components, where the major components are zinc oxide or titanium dioxide, and the minor components or other metal oxides (such as listed above) that melt of diffuse to the grain boundary of the major component through a process such as sintering.

The particle loading level of VSD material using core shelled particles, as described by embodiments herein, may vary below or above the percolation threshold, depending on the electrical or physical characteristics desired from the VSD material. Particles with high bandgap (e.g. using insulative shell layer(s)) may be used to enable the VSD composition to exceed the percolation threshold. Accordingly, in some embodiments, the total particle concentration of the VSD material, with the inclusion of a concentration of core shelled particles (such as described herein), is sufficient in quantity so that the particle concentration exceeds the percolation threshold of the composition. In particular, some embodiments provide that the concentration of core shelled particles may be varied in order to have the total particle constituency of the composition exceed the percolation threshold.

Under some conventional approaches, the composition of VSD material has included metal or conductive particles that are dispersed in the binder of the VSD material. The metal particles may range in size and quantity, depending in some cases on desired electrical characteristics for the VSD material. In particular, metal particles may be selected to have characteristics that affect a particular electrical characteristic. For example, to obtain lower clamp value (e.g. an amount of applied voltage required to enable VSD material to be conductive), the composition of VSD material may include a relatively higher volume fraction of metal particles. As a result, it becomes difficult to maintain a low initial leakage current (or high resistance) at low biases due to the formation of conductive paths (shorting) by the metal particles.

Figure 2A:
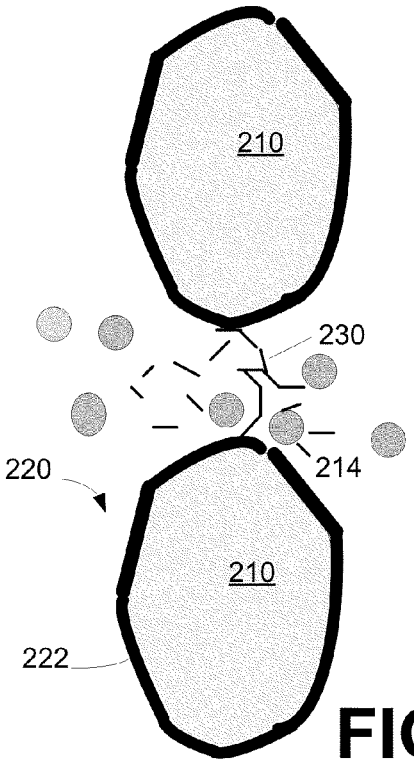
FIG. 2A illustrates use of a core shell structure for metal particle constituents of a composition of VSD material, under an embodiment.

FIG. 2A illustrates a core shell structure that can substitute for non-shelled conductive particle constituents (e.g. metal particles) for use in a composition of VSD material, according to an embodiment. As used herein, a core shell particle includes a core and one or more shell layers. According to some embodiments, at least some metal particles 210 that are constituents of VSD material 100 (see FIG. 1) are modified into conductive core shell particles 220 that, when dispersed in sufficient quantity in the binder (not shown), reduce the creation of off-state leakage current and enable increase concentration of metal/conductive particles (including HAR particles), even beyond the level of percolation. An embodiment of FIG. 2A depicts VSD material 100 (FIG. 1) as comprising conductive core shell particles 210 and semiconductive particles 214. The addition of HAR particles 230 may further enhance the electrical characteristics of the composition. The use of core shell particles, with other particles (such as HAR particles) enable the total particle concentration loaded into the binder 105 (see FIG. 1) to equal or exceed the percolation level. In absence of core shell structures 210, loading particles beyond percolation would cause the VSD material 200 to lose its electrical characteristics of being insulative in absence of a field that exceeds some threshold. Specifically, the VSD material may behave as a conductor. But the use of core shell particles 210 enables higher loading concentrations of particles, such as HAR particles and semiconductor particles, thereby enabling the composition of VSD material to have lower clamp voltages and leakage current.

Figure 2B:
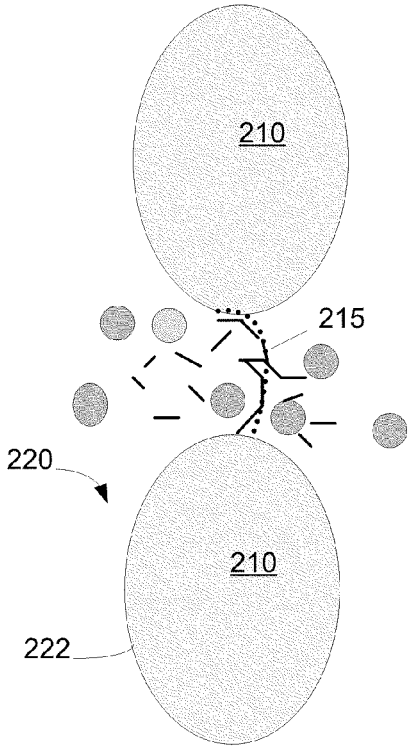
FIG. 2B illustrates VSD material that includes a combination of conductive/semiconductive and/or nano-dimensioned particles, to illustrate a comparison with other embodiments described herein.

FIG. 2B illustrates VSD material that includes a combination of conductive/semiconductive and/or nano-dimensioned particles, to illustrate a comparison with embodiments in which a VSD composition includes core shell particles (single or multi-layered). In FIG. 2B, the particles of the VSD composition are shown to inadvertently align to form incidental conductive paths 215. The incidental conductive path 215 may arise from conductive regions of individual particles being sufficient to cause some current flow across a thickness of the VSD material 100 (see FIG. 1). While VSD material may be mixed to minimize such contacts, the more conductive particles exist in the VSD composition, the more likely the formation of conductive regions and incidental conductive paths. If sufficient number of particles combine to form a path across a thickness of the VSD material, undesirable effects may result. For example, such incidental conductive paths 215 can yield undesirably high leakage current (or low off-state resistance). Moreover, the probability that conductive particles combine to form incidental conductive paths 215 increases when the concentration of particles that form conductive regions approaches the percolation threshold.

As shown by an embodiment of FIG. 2A, core shell particles 220 are formed by conductive particles 210 that are processed to include one or more shell layers 222. The layers 222 may include semi- or non-conductive materials that buffer the individual particles from forming incidental conductive paths with other particles (such as shown in FIG. 2B). Thus, for example, mere contact by two adjacent core shelled particles 220 may avoid a result in which the two particles pass current as a result of contact of conductive regions, when two similarly situated conductor particles would otherwise pass current under similar circumstances. Thus, core shell particles can be substituted in for non-shelled conductor particles, as the semiconductive or non-conductive shell hinders two adjacent or touching particles from forming an incidental conductive path 215. Such core shell particles, on the other hand, can be included in the VSD composition in sufficient quantity to enable at least a portion of the composition to switch into the conductive state when the external voltage exceeds a characteristic value.

Accordingly, the metal particles 210 of the VSD material 200 are provided one or more layers of shell material 222. The shell material 222 may be semi-conductive or insulative, such provided through formation of a metal oxide shell. The metal oxide shell may be formed by, for example, thermal oxidation. As described below, the shell material 222 may be heterogeneous, so that the shell layer or layers are formed from multiple types of material. A heterogeneous core shell particle may be formed from (i) different kinds of shell layers in an individual shell layer, and/or (ii) multiple layers that are each homogeneous but formed from a different kind of material. One or more shell formation processes may be used to form the shell material 222 on individual particles. In one implementation, the oxide shell may be formed to include a relatively uniform thickness. Alternatively, the shell material may be formed to be non-uniform.

According to an embodiment provides that the shell material 222 is formed from metal oxide particles to surround the core metal particle 210. The core metal particles may be dimensioned in the micron or sub-micron range.

As mentioned, it is believed that incidental conductive paths 215 (FIG. 2B) may be formed in the VSD material 200 when metal particles 210 and/or other particles (e.g. HAR particles 216) randomly touch or align (so that their respective conductive regions pass current to one another). The presence of such incidental conductive paths 215 introduces leakage current, which can affect the quality and the expected or desired electrical characteristics of the composition of VSD material 200. In contrast, embodiments provide that by forming the shell material 220 out of one or more layers of semiconductive or resistive materials, the metal particles 210 are provided a shield against such incidental contacts. The incidental conductive path 215 that could otherwise form is impeded in its creation by the presence of the shell material about the metal particle 210. As mentioned, among other benefits, the particle loading may exceed the percolation threshold of the VSD composition.

Core Shell Particles

According to some embodiments, core shell particles are comprised of metal particles that are mixed with an oxide precursor solution to control the composition and thickness of an oxide shell on the particle. By mixing metal particles with an oxide precursor solution, it is possible to control the composition and thickness of a given layer of oxide shell. Further sintering at elevated temperature enables more durable and uniform oxide shell creation about individual metal particles.

Still further, embodiment recognize that it is also possible to form a shell with material other than oxide, such as an organic shell to impart additional properties to the metal particles.

The conductive particles 210 (i.e. the 'cores') that can be shelled and used as constituents of VSD material 200 may be selected from a wide range of materials, including (i) metals such as nickel, aluminum, titanium, iron, copper, or tungsten, stainless steel or other metal alloys; (ii) conductive metal oxides like antimony doped tin oxide, indium doped tin oxide, aluminum doped zinc oxide, and antimony doped zinc oxide. The shell material used to modify the conductive particle 210 can be insulative, or semiconductive. In some variations, it is possible for at least one shell layer to be formed from material that is conductive. According to embodiments, the shell material used to make the surface modification (the shell material) may correspond to a metal oxide, such as tin oxide, zinc oxide, titanium oxide, aluminum oxide, silicon oxide, nickel oxide, or copper oxide. Still further, an embodiment provides that colloidal solutions of oxide nanoparticles are formed in the presence of the conductive particles (e.g. nickel). Still further, the metal/metal oxides are low melting, e.g. less than 1000° C., such as metals and their corresponding oxides from bismuth, chromium, antimony, and praseodynium. Adsorption of the colloidal nanoparticles onto the conductive particle surface may occur by van der Waals force, electrostatic attraction, covalent bonding, steric entrapment or other means under appropriate conditions. This bound surface layer is then solidified by heating up to certain temperature in air, thus ensuring uniform coating of the conductive particles by the surface coating material. In another embodiment, conductive particles are mixed with various sol solutions with well established sol gel chemistry. The particles may be agitated and dispersed in the sol medium. After evaporation of solvent and drying a gel coating forms on the conductive particle surface which can be further solidified by heating at elevated temperatures.

Figure 2C:
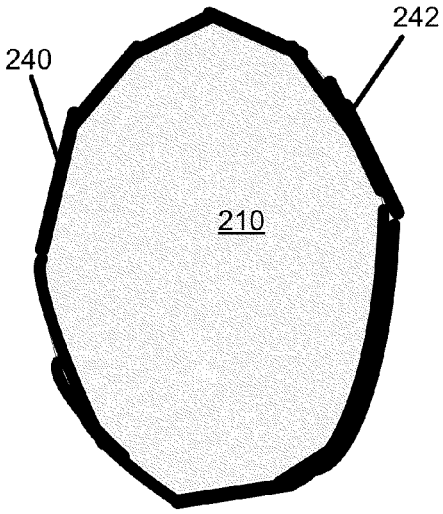
FIG. 2C illustrates conductor particles having two or more layers of shell material.

Additional coatings of the same or different coating materials can be applied onto the conductive particles surface repeatedly in similar fashion. FIG. 2C illustrates conductor particles having two or more layers of shell material. In particle, shell regions 240, 242 may include shell material bonded on shell material through performance of one or more shell forming processes, as described above. The double shell regions 240, 242 are provided either (i) substantially non-uniformly so that an exterior most shell layer exposes an underlying shell layer, or (ii) the shell regions are formed uniformly over one another. In an embodiment, separate shell forming processes may be performed sequentially to provide each shell material thickness. As such, each layer of shell material that results from performance of one shell formation process may provide or enhance a specific electrical property of the VSD material when the core shell material is used. Each of the two or more layers may be formed using processes such as described above. Moreover, each layer or thickness may comprise different kinds of material.

Figure 2D:
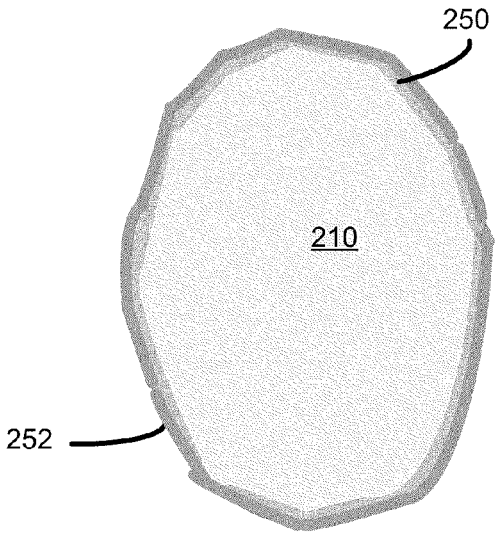
FIG. 2D illustrates conductor particles having a shell formation layer that comprises two or more kinds of materials.

FIG. 2D illustrates conductor particles having a shell formation layer that comprises two or more kinds of materials. In contrast to an embodiment of FIG. 2A, each shell material 250, 252 may bond directly to the conductor core 210, or alternatively formed in the same shell forming process. In some implementations, it is possible for some portion of the overall shell material to bond with other types of shell material to provide the shell formation. To provide shell formations comprised of multiple kinds of materials, an embodiment provides that the core conductive particles are submerged or exposed to a precursor solution that has the desired shell materials. As an alternative to a precursor solution, an organo-metallic solution containing desired shell material (which may include different types of shell material) may be used. In an embodiment shown, each of the layers of shell material 250, 252 are substantially uniform. However, one or more both layers may be non-uniform, so that the exterior 252 exposes the underlying shell material 250, or even the core 210.

With regard to FIG. 2C and FIG. 2D, the core and shell materials of the core shell particle constituents may be selected based on desired electrical or physical characteristics. In particular, an overall electrical or physical characteristic of the VSD material as a whole may be tuned (or intentionally affected) through selection of a core particle or a shell material (for one or more layers). The use of multiple shell layers and/or multiple kinds of shell material further enhance the ability for VSD material to be designed or tuned for a particular electrical or physical characteristic, in that additional shell material and/or layers may be incorporated into the design/tuning of the VSD composition. Among the characteristics of VSD material that can be tuned with selection of shell/core material, the (i) on- or off-state resistance, (ii) band-gap and (iii) wettability of the VSD material may be affected with core or shell material selection.

The formation of each type of material may be performed in one combined process (e.g. one precursor solution with multiple types of material) or in multiple processes (e.g. separate precursor solution for each shell material type). In one embodiment, when heterogeneous shells are formed, the material that comprises the shells may have different electrical properties or characteristics. For example, one implementation may combine a metal oxide and a nano-particle as the shell material, while another implementation may use two kinds of metal oxides as the shell material.

As shown by FIG. 2C and FIG. 2D, multilayer and/or heterogeneous material coating with complicated physical properties can thus be realized. The following provide more detailed examples of shell material formed on metal particles.

CORE SHELL PARTICLE FORMULATION EXAMPLES

1. Nickel Oxide Shell

In one embodiment, nickel oxide forms at least one of the shell layers, and is formed a metal particle core. A core shell particle (for use with VSD composition) comprising nickel core and nickel oxide shell material may be formulated as follows: (1) Mix 120 mL 1M NiSO4 solution with 90 mL 0.2M K2S2O8 solution and 60 mL DI water; (2) Add 1100 g of Ni (for example, Novamet 4SP-10) to the above solution; (3) Mix with an overhead mixer for duration; and (4) Add 24 mL NH4OH solution (30% wt) quickly and under vigorous stirring. The mixture is further mixed for 8 hrs at room temperature. The solution is filtered and rinsed with DI water and ethanol. The filtered powder is then dried at 100 C in vacuum for 2 hour. The dried powder is finally heated in a furnace at 300 C for 1 to 3 hours. All the chemicals are obtained from Sigma-Aldrich.

In embodiment, the coating formulation includes (i) 20 to 30% vol surface modified nickel particles, (ii) 5 to 25% vol metal oxide semiconductors with primary particle size less than 1 um (e.g. TiO2). Epoxy and epoxy functionalized polymers are used as the polymer matrix materials, solvents can be added to adjust viscosity for mixing (i.e. N-methypyrrolidinone or 1-methoxy-2-propanol). Appropriate types and amounts of cross-linkers may be dispersed in the binder. Small amount of dispersants may be used to disperse particles with size less than 1 um.

Results: A layer of VSD material with 26% vol 4SP-10 nickel treated as above, formulated such as described above, has a resulting clamp voltage of 263V at 5 mil electrode gap size. Resistances of all samples before and after testing are greater than 10^10 ohm at low biases.

A layer of VSD material with 26% vol treated 4SP-20 nickel and 2% untreated INP-400 nickel (both from Novamet) has a resulting clamp voltage of 194V at 5 mil electrode gap size. Resistances of sample are greater than 10^10 ohm before testing and greater than 10^6 ohm after testing at low biases.

2. Zinc Oxide Shell

In another embodiment, zinc oxide is used for shell material. A zinc oxide shell may be formed over a metal particle. Formation of a core shell particle that uses a zinc oxide shell may be as follows: (1) 1M zinc acetate solution is used to form zinc oxide on the nickel particle surface; (2) 120 mL 1M zinc acetate solution is mixed with 90 mL 0.2M K2S2O8 solution and 60 mL DI water; (3) 1100 g of Ni (for example, Novamet 4SP-20) is added to the above solution and mixed with an overhead mixer; (4) After 15 minutes, 24 mL NH4OH solution (30% wt) is added quickly under vigorous stirring. The mixture is further mixed for 8 hrs at room temperature. The resulting mixture is filtered and rinsed with DI water and ethanol for several times. The filtered powder is then dried at 100° C. in vacuum for 2 hour. The dried powder is finally heated in a furnace at 300° C. for 2 hours. All the chemicals are obtained from Sigma-Aldrich.

A VSD coating with 26% vol 4SP-20 nickel treated as above has a resulting clamp voltage of 238V at 5 mil electrode gap size. Resistances of all samples before and after testing are greater than 10^10 ohm at low biases.

3. Titanium Oxide Shell

Still further, an embodiment provides for titanium oxide as the shell material. One or more layers of titanium oxide shell are formulated over a metal particle. Formation of a core shell particle that includes a titanium oxide shell may be as follows: (1) 50 mL of titanium tetraisopropoxide may be mixed with 250 mL of 2-methoxyethanol and 25 mL of ethanolamine; (2) While keeping under argon flow, the mixture is heated at 80° C. and 120° C. for 1 hour each and repeated once. The resulting product used the titanium oxide precursor solution to coat nickel particles.

Under one formulation, 200 g of above titanium oxide precursor solution is mixed with 500 g of isopropanol. Next, 600 g of nickel powder (for example, Novamet 4SP-20) is added under vigorous stirring by an overhead stirrer and sonicated at the same time. After sonicating (or mixing) for 60 minutes, the sonicator horn is removed. Stirring may be maintained with heating at 70° C. to remove most of volatile solvents in the mixture. The mixture may be placed in an oven at 80° C. until all solvents evaporate. The dried powder is then heated at 300° C. for two hours and used in coating formulation.

A VSD coating with 26% vol 4SP-20 nickel treated as above gives a clamp voltage of 309V at 5 mil electrode gap size. Resistances of all samples before and after testing are greater than 10^10 ohm at low biases.

Still further, in another embodiment, a core shell may comprise a metal-core, a metal oxide shell, and a polymer shell. In one implementation, the metal core is nickel, and the oxide shell is nickel oxide. The polymer shell may be formed using, for example, hydrosiloxane treatment, other embodiments would include reacting the surface of the shell with silane coupling agents such as aminopropyltriethoxysilane, acryloxypropyltriethoxysilane, or epoxypropyltriethoxysilane.

Still further, some embodiments provide for a core shell particle that comprises a cross-lined polymer shell formed using a hydrosiloxane treatment. A cross-linked polymer shell may be formed by linking hydrosiloxane group polymers that comprise the shell of the core shelled particle. This polymer (e.g. polymethylhydrosiloxane) is cross-linked with platinum or peroxide in solution. More specific examples of surface-modifying particles for use as core shell particle constituents of VSD material are described below.

Surface Modification of Metal Particles

Oxidized Ni particles may be treated with a D4-H molecule (1,3,5,7-tetramethyl cyclotetrasiloxane, from Gelest) using the vapor phase reaction. 600 g of oxidized Ni power is transferred into a 500 ml teflon container. Then 3% by wt of D4-H is added. The container is mixed and placed in a furnace set at a temperature of 150° C. for several hours. Since the boiling point of D4-H is 135° C., D4-H vaporizes at 150° C. resulting in the ring opening polymerization of D4-H on the $NiO/NiO_2$ surface of Ni. The Ni particles are rinsed with ethanol and DI The filtered powder is dried.

The surface modification of nickel oxide with siloxanes (monomeric or polymeric) can be carried out either by solution or vapor phase reaction. In the following two examples, the solution and vapor phase reactions of nickel oxide with 1,3,5,7-tetramethylcyclotetrasiloxane (D4H) are described. In addition to D4H, other siloxanes can be employed for such reactions on nickel surfaces; Octamethylcyclotetrasiloxane (D4), octamethyltrisiloxane (Si3), decamethyltetrasiloxane (Si4), dodecamethylpentasiloxane (Si5), octylsilane, polymethylhydridosiloxane and polydimethylsiloxane (PDMS).

Solution phase reaction of 1,3,5,7-tetramethylcyclotetrasiloxane (D4H) on nickel oxide: About 2-5% volume of D4H with respect to a solvent is treated with nickel oxide. The solvents may correspond to, for example hexane, heptanes or toluene. The reaction temperatures are typically 90-110° C. and the reaction times may vary. In one process, 2.5 g of D4H and 100 g of nickel are taken in 150 g of toluene and refluxed for a duration. After the reaction, the reaction mixture are treated and dried at 100° C. overnight to obtain the product in 90-95% yield.

Vapor phase reaction of 1,3,5,7-tetramethylcyclotetrasiloxane (D4H) on nickel oxide: About 2-10 weight % of D4H may be taken with nickel oxide in an autoclavable teflon container. This is heated to above the boiling point of D4H in an oven. As an example, 15 g of D4H is taken with 600 g of nickel oxide using a sealed teflon container. This is placed in a pre-heated oven at 150° C. The container is then cooled to room temperature, and the nickel oxide is washed with toluene to remove the un-attached siloxane monomer and filtered. Further drying provides surface modified nickel oxide in 90-95% yield.

Other types of reactions on siloxane-modified nickel oxide are possible. For example, the Si—H group can be used for coupling hydridosilane with other functional group containing olefins to tailor the surface chemistry. An allyl amine or acrylonitrile can be used to react with hydridosiloxane-modified nickel oxide using a Platinum catalyst (eg. Chloroplatinic acid). This will result in nickel oxide surfaces containing amine or nitrile end groups. Similarly, the reaction with perfluorobutylethylne results in highly fluorine-rich end groups on the nickel oxide surface.

In another example, the siloxane-treated nickel oxide surface is treated with a radical initiator such as benzoyl peroxide that can generate silyl radical, which in turn may initiate a polymerization of olefinic substrates, such as acrylate monomers. As an example, D4H-modified nickel oxide was reacted with hexanediol-diacrylate in presence of benzoyl peroxide to give nickel oxide covered with acrylate shell.

Table 1 lists a summary of the atomic composition of the surface modified nickel that can be included in VSD composition, according to some embodiments as measured by x-ray photoelectron spectroscopy.

TABLE 1

| Surface Oxide | Ni Type | Ni % AT | O % AT | Zn % AT | Ti % AT |
|---|---|---|---|---|---|
| Nickel oxide | 4SP-10 | 89.2 | 10.8 | | |
| Nickel oxide | 4SP-20 | 91.02 | 8.98 | | |
| Zinc oxide | 4SP-20 | 88.34 | 10.22 | 1.44 | |
| Titanium oxide | 4SP-20 | 71.88 | 23.38 | | 4.74 |

VSD Formulation Using Core Shelled Particles

With reference to embodiments described, the core shell particles may be formulated using the following example. Core shell particles such as described may be included as one of the particle constituents of VSD material, in a manner described with prior embodiments. In one embodiment, the VSD material includes nanoparticles, such as carbon-nanotubes as particle constituents. The nanoparticles (0.6 g) are mixed into the polymer binder (e.g. EPON 828 or difunctional bisphenol A/epichlorohydrin by HEXION) (70.8 g)

and GP611 epoxy functional dimethylpolysiloxane copolymer, by GENESEE POLYMERS CORP.) (70.8 g). A solvent such as N-methyl-2-pyrrolidone is added (140 g). Appropriate curing and catalyst agents are applied and mixed uniformly. A pre-mixture is formed comprising nanoparticles (e.g. carbon nanotubes), resin and solvent. 78.5 g of $TiO_2$ and 2.6 g of isopropyl tri(N-ethylenediamino)ethyl titanate are added during the mixing process. 617.8 g of wet-chemistry processed oxidized Ni particles (provided as core shelled particle constituents) are then added with 85.1 g of additional $TiO_2$ and 142.3 g of $Bi_2O_3$. Mixing was continued to achieve uniform constituency. High shear mixing over long durations is used to achieve desired uniformity, optionally sonication may also be desirable to improve mixing. According to an embodiment, the formulation results in VSD material that comprises Ni core shell particles having a trigger voltage of approximately 313V and a clamp voltage of approximately 217V for a 3 mil gap with 20 pad diameter measured by a transmission line pulse.

Figure 3A:
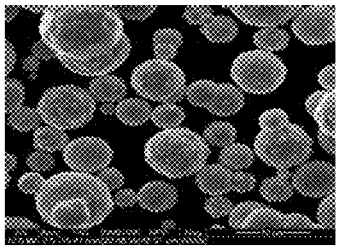
FIG. 3A through FIG. 3C illustrate actual images of surface-modified conductive particles that are formed using a precursor solution to form the shell material.
Figure 3B:
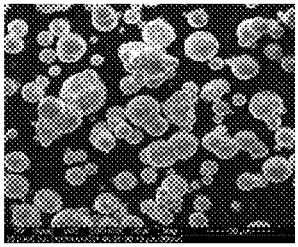
Figure 3C:
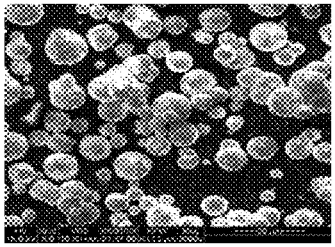

FIG. 3A through FIG. 3C illustrate actual images of surface-modified conductive particles that are formed using a precursor solution to form the shell material. Specifically, FIG. 3A illustrates VSD material having nickel core shell particles, where the shell material is nickel oxide. FIG. 3B illustrates zinc oxide as the shell material on core nickel particles. FIG. 3C illustrates titanium oxide shells formed on nickel. The examples further show that the shells may be formed to different sizes. Reduction in size may enable greater quantities of the core particle to be used. The shell material, more preferably, is a metal oxide composed of 2 different metal oxide materials in the shell leading to synergistic electrical properties. For example, nickel metal particles can be treated and coated to form a nickel metal core and NiOx—ZnO shell. The shell would have better conductive properties than NiOx alone and better insulative properties and an ZnO only shell. Another example would be a nickel metal core and a NiOx—TiOx shell. NiOx has a lower band gap but TiOx is extremely durable under high voltage pulsing, is hydrolytically stable, and is corrosion resistant. Hence, synergistically enhanced shell properties can be enhanced by mixed metal oxide shell construction.

As an alternative to embodiments described, the core of the core shell particle may comprise a varistor particle, such as zinc-oxide or titanium dioxide. Still further, other embodiments may mix varistors and core shell particles such as described herein.

VSD Material Applications

Numerous applications exist for compositions of VSD material in accordance with any of the embodiments described herein. In particular, embodiments provide for VSD material to be provided on substrate devices, such as printed circuit boards, semiconductor packages, discrete devices, thin film electronics, as well as more specific applications such as LEDs and radio-frequency devices (e.g. RFID tags). Still further, other applications may provide for use of VSD material such as described herein with a liquid crystal display, organic light emissive display, electrochromic display, electrophoretic display, or back plane driver for such devices. The purpose for including the VSD material may be to enhance handling of transient and overvoltage conditions, such as may arise with ESD events. Another application for VSD material includes metal deposition, as described in U.S. Pat. No. 6,797,145 to L. Kosowsky (which is hereby incorporated by reference in its entirety).

Figure 4A:
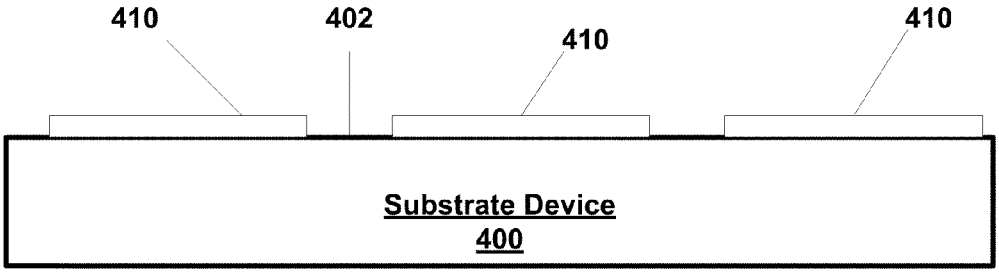
FIG. 4A and FIG. 4B each illustrate different configurations for a substrate device that is configured with VSD material having a composition such as described with any of the embodiments provided herein.
Figure 4B:
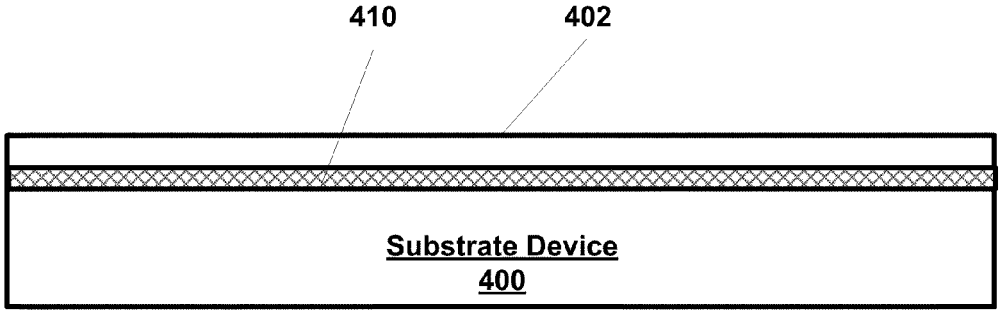

FIG. 4A and FIG. 4B each illustrate different configurations for a substrate device that is configured with VSD material having a composition such as described with any of the embodiments provided herein. In FIG. 4A, the substrate device 400 corresponds to, for example, a printed circuit board. In such a configuration, VSD material 410 (having a composition such as described with any of the embodiments described herein) may be provided on a surface 402 to ground a connected element. As an alternative or variation, FIG. 4B illustrates a configuration in which the VSD material forms a grounding path that is embedded within a thickness 410 of the substrate.

Electroplating

In addition to inclusion of the VSD material on devices for handling, for example, ESD events, one or more embodiments contemplate use of VSD material (using compositions such as described with any of the embodiments herein) to form substrate devices, including trace elements on substrates, and interconnect elements such as vias. U.S. patent application Ser. No. 11/881,896, filed on Sep. Jul. 29, 2007, and which claims benefit of priority to U.S. Pat. No. 6,797,145 (both of which are incorporated herein by reference in their respective entirety) recites numerous techniques for electroplating substrates, vias and other devices using VSD material. Embodiments described herein enable use of VSD material, as described with any of the embodiments in this application.

Other Applications

Figure 5:
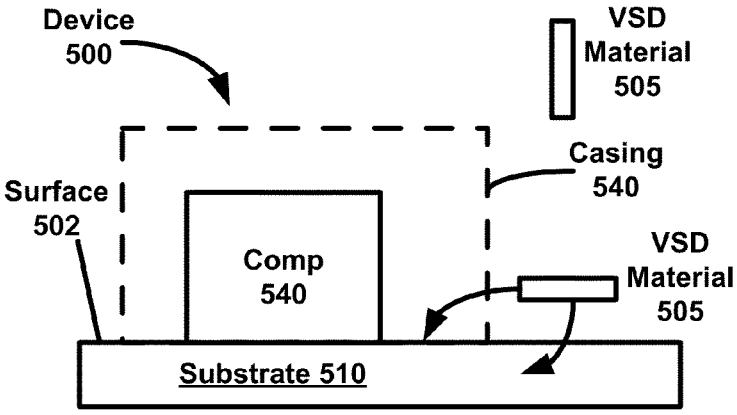
FIG. 5 is a simplified diagram of an electronic device on which VSD material in accordance with embodiments described herein may be provided

FIG. 5 is a simplified diagram of an electronic device on which VSD material in accordance with embodiments described herein may be provided. FIG. 5 illustrates a device 500 including substrate 510, component 520, and optionally casing or housing 550. VSD material 505 (in accordance with any of the embodiments described) may be incorporated into any one or more of many locations, including at a location on a surface 502, underneath the surface 502 (such as under its trace elements or under component 520), or within a thickness of substrate 510. Alternatively, the VSD material may be incorporated into the casing 550. In each case, the VSD material 505 may be incorporated so as to couple with conductive elements, such as trace leads, when voltage exceeding the characteristic voltage is present. Thus, the VSD material 505 is a conductive element in the presence of a specific voltage condition.

With respect to any of the applications described herein, device 500 may be a display device. For example, component 520 may correspond to an LED that illuminates from the substrate 510. The positioning and configuration of the VSD material 505 on substrate 510 may be selective to accommodate the electrical leads, terminals (i.e. input or outputs) and other conductive elements that are provided with, used by or incorporated into the light-emitting device. As an alternative, the VSD material may be incorporated between the positive and negative leads of the LED device, apart from a substrate. Still further, one or more embodiments provide for use of organic LEDs, in which case VSD material may be provided, for example, underneath an organic light-emitting diode (OLED).

With regard to LEDs and other light emitting devices, any of the embodiments described in U.S. patent application Ser. No. 11/562,289 (which is incorporated by reference herein) may be implemented with VSD material such as described with other embodiments of this application.

Alternatively, the device 500 may correspond to a wireless communication device, such as a radio-frequency identification device. With regard to wireless communication devices such as radio-frequency identification devices (RFID) and wireless communication components, VSD material may protect the component 520 from, for example, overcharge or ESD events. In such cases, component 520 may correspond to a chip or wireless communication component of the device. Alternatively, the use of VSD material 505 may protect other components from charge that may be caused by the component 520. For example, component 520 may correspond to a battery, and the VSD material 505 may be provided as a trace element on a surface of the substrate 510 to protect against voltage conditions that arise from a battery event. Any composition of VSD material in accordance with embodiments described herein may be implemented for use as VSD material for device and device configurations described in U.S. patent application Ser. No. 11/562,222 (incorporated by reference herein), which describes numerous implementations of wireless communication devices which incorporate VSD material.

As an alternative or variation, the component 520 may correspond to, for example, a discrete semiconductor device. The VSD material 505 may be integrated with the component, or positioned to electrically couple to the component in the presence of a voltage that switches the material on.

Still further, device 500 may correspond to a packaged device, or alternatively, a semiconductor package for receiving a substrate component. VSD material 505 may be combined with the casing 550 prior to substrate 510 or component 520 being included in the device.

Although illustrative embodiments have been described in detail herein with reference to the accompanying drawings, variations to specific embodiments and details are encompassed herein. It is intended that the scope of the invention is defined by the following claims and their equivalents. Furthermore, it is contemplated that a particular feature described, either individually or as part of an embodiment, can be combined with other individually described features, or parts of other embodiments. Thus, absence of describing combinations should not preclude the inventor(s) from claiming rights to such combinations.

What is claimed is:

1. A voltage switchable dielectric (VSD) material comprising:

a binder; and a set of core shelled particles dispersed in the binder, wherein each core shell particle in the set comprises:

(i) a conductor core; and (ii) a shell comprising a plurality of layers, including a first layer of a first material and a second layer of a second material that is different than the first material.

2. The VSD material of claim 1, wherein the set of particles are dispersed in the binder in a concentration that is at or above a percolation level of the composition.

3. The VSD material of claim 1, further comprising non-core shelled particles that are conductors or semi-conductors.

4. The VSD material of claim 1, further comprising non-core shelled particles that are nano-dimensioned particles.

5. The VSD material of claim 4, wherein the nano-dimensioned particles are high-aspect ratio particles.

6. The VSD material of claim 4, wherein the nano-dimensioned particles are organic.

7. The VSD material of claim 4, wherein the nano-dimensioned particles include carbon nano-tubes.

8. The VSD material of claim 4, wherein the nano-dimensioned particles include high-aspect ratio metal particles.

9. The VSD material of claim 1, further comprising Boron particles other than the set of core shelled particles.

10. The VSD material of claim 1, further comprising active varistor particles other than the set of core shelled particles.

11. The VSD material of claim 1, wherein the binder is formed from a conductive polymer.

12. The VSD material of claim 1, wherein the shell of at least some of the core shell particles in the set includes a semi-conductive or resistive material.

13. The VSD material of claim 1, wherein the conductor core of at least some of the core shelled particles in the set includes a metal particle.

14. The VSD material of claim 13, wherein the shell of at least some of the core shelled particles in the set includes one or more kinds of oxides.

15. The VSD material of claim 14, wherein the shell of at least some of the core shell particles in the set includes one or more kinds of oxides formed on the metal particles.

16. The VSD material of claim 13, wherein the shell of at least some of the core shelled particles in the set includes one or more kinds of metal-oxides.

17. The VSD material of claim 1, wherein at least one of the first layer or the second layer of the shell of one or more of the core shelled particles in the set is comprised of a layer that is formed from two or more types of material.

18. The VSD material of claim 1, wherein at least one of the first layer or the second layer of the shell of one or more core shelled particles in the set is non-uniform, so as to expose the conductor core or an underlying shell.

19. The VSD material of claim 1, wherein at least some of the core shelled particles in the set comprise a nickel core and a metal oxide shell.

20. A VSD material comprising:

a polymer binder;

a set of core shelled particles that individually comprise a metal core and a shell, wherein the shell is multi-layered, and is comprised of multiple kinds of material, including a metal oxide.

21. The VSD material of claim 20, wherein the set of particles are dispersed in the binder in a concentration that is at or above a percolation level of the composition.

22. The VSD material of claim 20, further comprising non-core shelled particles that are conductors or semi-conductors.

23. The VSD material of claim 20, further comprising non-core shelled particles that are nano-dimensioned particles.

24. The VSD material of claim 23, wherein the nano-dimensioned particles are high-aspect ratio particles.

25. The VSD material of claim 23, wherein the nano-dimensioned particles are organic.

26. The VSD material of claim 23, wherein the nano-dimensioned particles include carbon nano-tubes.

27. The VSD material of claim 23, wherein the nano-dimensioned particles include high-aspect ratio metal particles.

28. The VSD material of claim 20, wherein at least one of the first layer or the second layer of the shell of at least some of the core shelled particles in the set is non-uniform, so as to expose the conductor core or an underlying shell.

* * * * *